United States Patent [19]

Loomis

[11] 4,179,129

[45] Dec. 18, 1979

[54] STRUCTURALIZATION OF RULES

[76] Inventor: Louie P. Loomis, 601 North View Terr., Alexandria, Va. 22301

[21] Appl. No.: 938,062

[22] Filed: Aug. 30, 1978

Related U.S. Application Data

[63] Continuation of Ser. No. 844,037, Oct. 20, 1977, abandoned, which is a continuation-in-part of Ser. No. 683,335, May 12, 1976, abandoned.

[51] Int. Cl.[2] ..... A63F 3/00

[52] U.S. Cl. ..... 273/272; 273/282; 273/288

[58] Field of Search ..... 273/236, 240, 242, 272, 273/282, 288

[56] References Cited

U.S. PATENT DOCUMENTS

| | | | |
|---|---|---|---|
| 694,038 | 2/1902 | Stubbs | 273/159 |
| 843,490 | 2/1907 | Pusey | 273/159 |
| 1,553,835 | 9/1925 | Peters | 273/272 |
| 1,591,639 | 7/1926 | McDonald | 273/242 |
| 2,082,983 | 6/1937 | Shaffer | 273/236 |
| 2,782,530 | 2/1957 | Lorroca | 273/240 |
| 3,472,514 | 10/1969 | Green | 273/272 |
| 3,672,679 | 6/1972 | Burns | 273/282 X |
| 3,706,456 | 12/1972 | Sesti et al. | 273/276 |
| 3,877,703 | 4/1975 | Pierre | 273/240 X |

FOREIGN PATENT DOCUMENTS

| | | | |
|---|---|---|---|
| 481303 | 8/1929 | Fed. Rep. of Germany | 273/157 R |
| 26175 | of 1910 | United Kingdom | 273/272 |
| 465979 | 5/1937 | United Kingdom | 273/282 |

*Primary Examiner*—Anton O. Oechsle

[57] ABSTRACT

A word forming board game wherein the letter bearing pieces are placed on the board in sequential order in linear, non-linear, adjacent and/or non-adjacent arrays in conformance with prescribed placement rules to form words. For example, successive letters of a word may be placed on the board such that they reflect successive moves of a conventional chess piece such as a king, pawn or knight. In a preferred embodiment, the board is provided with a rectangular matrix of evenly spaced apertures and the letter bearing pieces are each provided with a central aperture. Pegs are used to immovably secure the pieces to the board and the board is provided with cord securing structures along opposing edges. Cords are provided and each of the cords can be extended from the peg associated with the letter piece forming the first letter of a word, around successive letters of that word and finally to one of the cord securing structures. The cord paths aid in visualizing the formed words.

1 Claim, 2 Drawing Figures

FIG.2
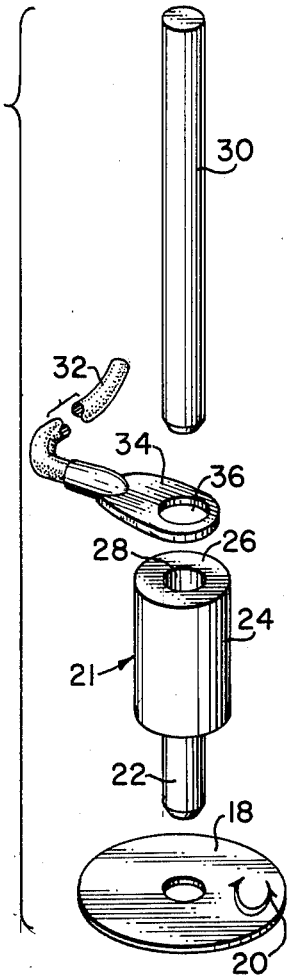
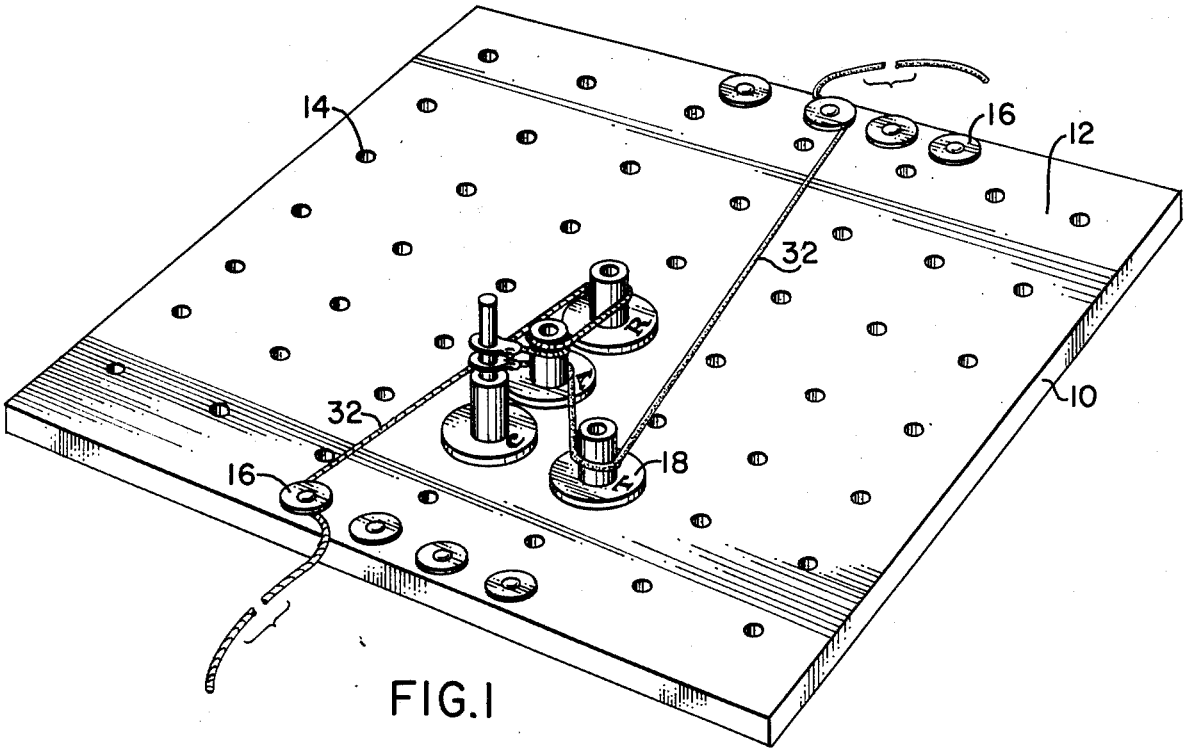
FIG.1

STRUCTURALIZATION OF RULES

This application is a continuation of application Ser. No. 844,037, filed Oct. 20, 1977, abandoned, which in turn was a continuation in part of application Ser. No. 683,335, filed May 12, 1976, abandoned.

SUMMARY OF THE INVENTION

An object of the invention is to provide a word-forming board game.

A further object of the invention is to provide a word-forming board game wherein the successively placed word-forming letter pieces are not necessarily placed in linear and/or adjacent relationship.

A further object of the invention is to provide a word-forming board game which includes structure which aids in visualizing letter formations of the non-linear and non-adjacent type.

These and other objects will be readily evident upon a study of the following specification and the accompanying drawing.

BRIEF DESCRIPTION OF THE DRAWING

FIG. 1 is a perspective view of the present invention; and

FIG. 2 is an exploded, enlarged view of a letter piece, peg structure, and cord fragment of the present invention.

DETAILED DESCRIPTION OF THE INVENTION

With reference to the drawing, there is illustrated in FIG. 1 a word forming game board generally indicated at 10. Formed in the top surface 12 of the board is a rectangular matrix of evenly spaced apertures 14. Disposed at opposing side edges of the board are rows of cord ties 16, the function of which will be explained hereinafter.

The playing pieces are in the form of thin washer-like elements 18 each provided with a letter 20 on a flat surface thereof. The playing pieces are provided in sufficient number and with a sufficient variety of letters to play the disclosed game.

A peg structure is provided to serve both to secure the playing pieces to the board and as an anchor point and/or path defining structure for cord elements to be described hereinafter. The peg structure consists of a lower peg element and an upper peg element. The lower peg element 2 has a lower portion 22 sized to be received in both the apertures in the playing pieces and board apertures 14, and an upper enlarged portion 24 terminating at its upper end in a flat surface 26 surrounding a central aperture 28. The upper peg element in turn consists of a constant diameter dowel 30 sized to be received in aperture 28.

A plurality of cord elements are also provided. Each cord element consists of a cord 32 having a flat extension 34 at one end thereof. Disposed in extension 34 is an aperture 36 large enough to receive dowel 30 but too small to receive enlarged portion 24 of peg element 21.

In playing the game, the players alternately place playing pieces 18 on board 10 in an effort to form words. The pieces forming the words need not be arranged linearly. In fact, the letter sequence can follow any applicable rule in any well known game. An example of one particular word-making rule is that conforming to the king's move in chess. Another example is that conforming to the pawn's move in chess. A third example is that wherein successive letters of a word are disposed in successive knight's moves locations relative to each other.

Play pieces 18 are each secured to the board via a peg element 21 by inserting lower portion 22 successively through the play piece aperture and an aperture 14 in the board. When it is desired to demonstrate or visualize a completed word, a cord 32 is secured to the peg structure associated with the first letter of that word by the interengagement of aperture 36 of extension 34 with dowel 30. (see FIG. 2) Cord 32 is then passed successively around the peg structures which are associated with successive letter pieces forming the word. After the cord is passed around the last so associated peg structure, the end opposite the end having flat extension 34 is wrapped around a cord tie 16 to secure the cord. Thus, a formed word can be checked by following the convolutions of the cord from the first letter piece to the last letter piece of the formed word.

While various changes may be made in the above described invention, it is understood that the invention is limited only as defined in the appended claim.

I claim:

1. A word forming board game comprising a board having a rectangular matrix of evenly spaced apertures, a plurality of letter bearing apertured playing pieces, a plurality of peg structures receivable through the apertures in said playing pieces and in said board apertures to fixedly secure pieces selectively on the board, said pieces being locatable on said board in linear, non-linear, adjacent and/or non-adjacent arrays in accordance with prescribed placement rules to form words, tie means located along opposing edges of the board, and cord means having a ring at one end sized to receive said peg structures, said cord means being of sufficient length such that the cord means can be extended from a selected peg structure associated with a playing piece bearing the first letter of a word formed by playing pieces on the board, wrapped in sequence around peg structures associated with the playing pieces bearing successive letters of said word, and finally tied to one or the other of said tie means.

* * * * *